US006286735B1

(12) United States Patent
Zuckerman

(10) Patent No.: US 6,286,735 B1
(45) Date of Patent: Sep. 11, 2001

(54) GARMENT HANGER WITH EXCLUSIVELY PLASTIC PINCH-GRIP

(75) Inventor: Andrew M. Zuckerman, Forest Hills, NY (US)

(73) Assignee: Carlisle Plastics, Inc., North Bergen, NJ (US)

( * ) Notice: Subject to any disclaimer, the term of this patent is extended or adjusted under 35 U.S.C. 154(b) by 0 days.

(21) Appl. No.: 09/539,065

(22) Filed: Mar. 30, 2000

(51) Int. Cl.[7] ..... A48G 25/48
(52) U.S. Cl. ..... 223/96; 223/93
(58) Field of Search ..... 223/96, 95, 93, 223/91, 85, 92, 88

(56) References Cited

U.S. PATENT DOCUMENTS

| | | | | |
|---|---|---|---|---|
| D. 190,843 | | 7/1961 | Levine et al. . | |
| D. 265,156 | | 6/1982 | Bisk et al. . | |
| D. 281,552 | | 12/1985 | Zuckerman et al. . | |
| D. 296,847 | | 7/1988 | Kawalek . | |
| D. 301,942 | | 7/1989 | Talbot-Titley . | |
| D. 324,459 | | 3/1992 | Gouldson et al. . | |
| D. 368,376 | | 4/1996 | Gouldson et al. . | |
| D. 387,912 | | 12/1997 | Fildan . | |
| 3,047,196 | * | 7/1962 | Levine et al. | 223/96 |
| 3,406,883 | * | 10/1968 | Crane | 223/96 |
| 3,744,685 | * | 7/1973 | Hart | 223/96 |
| 4,209,879 | * | 7/1980 | Paajanen | 223/96 |
| 4,871,097 | * | 10/1989 | Blanchard et al. | 223/85 |
| 5,113,554 | * | 5/1992 | Gallo et al. | 223/96 |
| 5,267,678 | | 12/1993 | Zuckerman . | |

* cited by examiner

*Primary Examiner*—Bibhu Mohanty
(74) *Attorney, Agent, or Firm*—Amster, Rothstein & Ebenstein

(57) ABSTRACT

A garment hangers has at least one clamp or pinch-grip formed exclusively of plastic for suspending a garment. The clamp includes an outer portion defining (i) a central aperture therethrough, and (ii) a peripheral gap therethrough communicating with the central aperture, an inner portion defining (i) a body configured and dimensioned to pass through the outer portion central aperture, and (ii) a tab communicating with the inner portion body and configured and dimensioned to pass through the outer portion peripheral gap, and a bight portion biasing the inner portion forwardly relative to the outer portion towards a retaining orientation for retaining a garment disposed at least partially intermediate a front of the inner portion and a rear of the outer portion. The inner portion is rearwardly displaceable by rearward pressure on the inner portion tab to a releasing orientation enabling a garment to pass intermediate a front of the inner portion and a rear of the outer portion.

19 Claims, 5 Drawing Sheets

10
52
22
60
40
G
42
30
54
53
20

6
10
24
12
60
7
7
20
22
20
G
6

GARMENT HANGER WITH EXCLUSIVELY PLASTIC PINCH-GRIP

BACKGROUND OF THE INVENTION

The present invention relates to a garment hanger having at least one clamp or pinch-grip formed exclusively of plastic for suspending a garment, and more particularly to such a hanger which may be manufactured economically and is adapted to both machine and manual garment loading operations.

Garment hangers having at least one clamp or pinch-grip formed exclusively of plastic for suspending a garment are well-known in the art. Once the appropriate production tools are provided, the cost of manufacturing each hanger through a conventional injection molding process is minimal.

Typically, the pinch-grip of a conventional garment hanger defines an overlap between the grip front leg and the grip back leg with the overlap providing the garment-suspending function. However, it is well-known that, in order to perform injection molding where two pieces overlap, it is necessary to use extremely expensive special injection molds which include slides or other moving parts. The cost of such specialized tooling increases the initial production tool costs and, when amortized, the unit cost per production unit.

During loading of a garment in such a hanger, especially machine loading of the hanger with the garment by automated equipment, the garment is inserted between the clamp legs to varying degrees. For example, the insertion process may terminate when the garment is only slightly up the channel between the two clamp legs or when the garment is further up the channel, and even adjacent the bight of the clamp. This non-uniformity of garment positioning is undesirable from an aesthetic point of view, even though it does not substantially affect the ability of the hanger clamp to suspend the garment. Thus it would be aesthetically desirable if the hanger clamp provided a stop mechanism which limited upward insertion of the garment into the clamp during both machine and manual assembly of the hanger and the garment.

The conventional hangers, as noted above, include an overlap between the front and back clamp legs and this overlap prevents a fully telescopic action between the two legs when aligned (front-to-back) hangers are pressed together—i.e., stacked. Accordingly, the clamp is necessarily relatively thick (typically thicker than the remainder of the hanger) and thus interferes with an economical stacking (whether horizontal or vertical) of an aligned plurality of the hangers. The result is increased packaging, shipping and storage costs.

Accordingly, it is an object of the present invention to provide a garment hanger having at least one clamp or pinch-grip formed exclusively of plastic for suspending a garment wherein there is no overlapping of the clamp legs so that no expensive special features are required on the injection molding equipment.

Another object is to provide such a hanger in which the clamp includes means for limiting automatic or manual insertion of a garment thereinto.

A further object is to provide such a hanger wherein the legs of the clamp are fully telescopic when aligned hangers are pressed together in a stack.

It is also an object of the present invention to provide such a garment hanger which is simple and economical to manufacture and use.

SUMMARY OF THE INVENTION

It has now been found that the above and related objects are obtained in a garment hanger having at least one clamp or pinch-grip formed exclusively of plastic for suspending a garment. The clamp comprises an outer portion defining (i) a central aperture therethrough, and (ii) a peripheral gap therethrough communicating with the central aperture, an inner portion defining (i) a body configured and dimensioned to pass through the outer portion central aperture, and (ii) a tab communicating with the inner portion body and configured and dimensioned to pass through the outer portion peripheral gap, and a bight portion connecting the inner and outer portions for biasing the inner portion forwardly relative to the outer portion towards a retaining orientation for retaining a garment disposed at least partially intermediate a front of the inner portion and a rear of the outer portion. The inner portion is rearwardly displaceable by rearward pressure on the inner portion tab to a releasing orientation enabling a garment to pass intermediate a front of the inner portion and a rear of the outer portion.

The inner and outer portions may be substantially rigid or resiliently flexible, but preferably the outer portion is substantially rigid and the inner portion is resiliently flexible.

In a preferred embodiment, the outer portion defines only a single central aperture and only a single peripheral gap. The inner portion tab, which is preferably of substantial width, projects downwardly from the inner portion body, and the outer portion peripheral gap projects downwardly from the outer portion central aperture. The inner and outer portions cooperatively define therebetween an hour glass-shaped space. In the retaining orientation the inner and outer portions are in a common plane when no garment is disposed therebetween. The bight potion connects the tops of the inner and outer portions.

In an especially preferred embodiment the hanger additionally includes a rib projecting forwardly of a front of the inner portion body and configured and dimensioned to pass through the outer portion central aperture, the rib being mounted on the inner portion body for movement therewith such that the inner portion body can be moved to the releasing orientation from the retaining orientation by rearward pressure on the rib.

Even when the hanger is in the releasing orientation, preferably the rib is configured and dimensioned to limit upward movement of a garment intermediate the inner and outer portions. The rib is of a thickness such that rearward pressure on the rib can displace the rib to an orientation wherein the front of the rib is not forward of the level of the front of the outer portion, and the back of the rib is not rearward of the level of the back of the outer portion, thereby to facilitate compact stacking of an aligned plurality of the hangers. Optionally the inner portion body can be moved to the releasing orientation from the retaining orientation by rearward pressure on either of the inner portion tab and the rib. Preferably the hanger includes a pair of ribs, one projecting forwardly from the front of the inner portion body, and one projecting rearwardly from the rear of the inner portion body.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
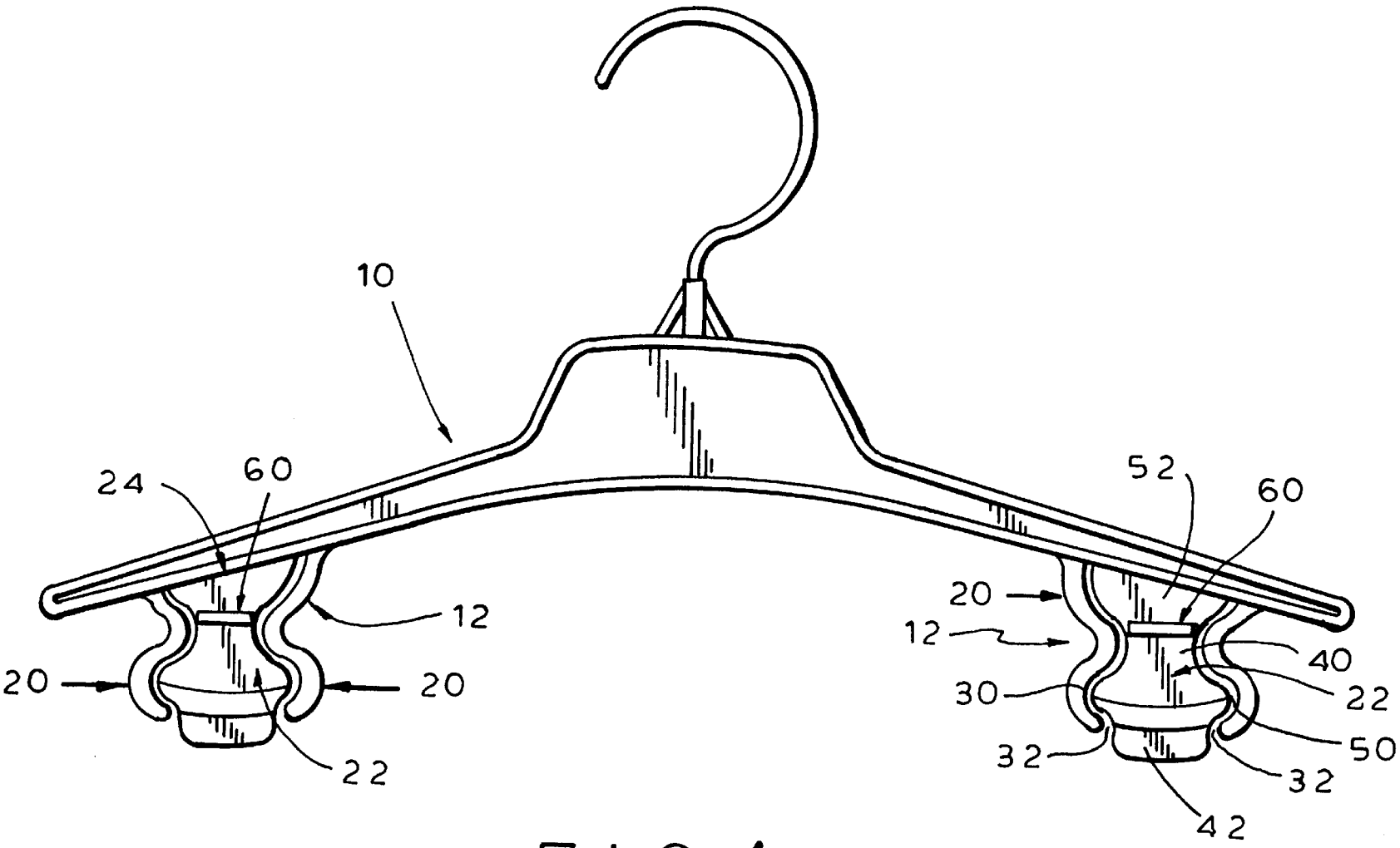
FIG. 1 is a front elevational view of a hanger according the present invention with a single rib.

The term "garment" as used herein and in the claims refers to an article of clothing of the type customarily suspended by a clamp or pinch-grip of a garment hanger—for example, pants, trousers, slacks, underpants, the bottoms of two piece bathing suits, shorts, and the like.

Referring now to the drawing, and in particular to FIGS. 1–8 thereof, therein illustrated is a garment hanger according to the present invention, generally designated by the reference numeral 10. The hanger 10 has at least one clamp or pinch-grip formed exclusively of plastic, generally designated 12, for suspending a garment G. The clamp 12 comprises an outer portion, generally designated 20, an inner portion, generally designated 22, and a bight portion, generally designated 24, connecting the inner and outer portions 22, 20, preferably at the tops thereof.

More particularly, the outer portion 20 defines a central aperture 30 therethrough and a peripheral gap 32 therethrough. The peripheral gap 32 communicates with the central aperture 30 so that, as illustrated, the outer portion 20 appears to be a horizontally spaced vertically-extending pair of curved lines. Preferably the outer portion 20 defines only a single central aperture 30 and only a single peripheral gap 32.

The inner portion 22 defines a body 40 configured and dimensioned to pass through the outer portion central aperture 30 and a tab 42 communicating with the inner portion body 40 and configured and dimensioned to pass through the outer portion peripheral gap 32. The tab 42 is preferably of substantial width to facilitate manual movement thereof.

The bight portion 24 connects the inner and outer portions 22, 20 and biases the inner portion 22 forwardly relative to the outer portion 20 towards a retaining orientation. In the retaining orientation, the inner and outer portions 22, 20 retain a garment at least partially disposed intermediate a front 52 of the inner portion 22 and a rear 54 of the outer portion 20. As illustrated, the bight portion 24 is of an inverted U-shape, with the bottoms of the depending legs of the bight portion being secured to and connecting the tops of the inner and outer portions 22, 20. The inner and outer portions 22, 20 preferably lie in a common plane when no garment is disposed therebetween. The inner portion 22 is rearwardly displaceable (relative to the outer portion 20) by rearward pressure on the inner portion tab 42 pushing it through and beyond the outer portion peripheral gap 32, so that the clamp 12 assumes a releasing orientation enabling a garment to pass intermediate a front 52 of the inner portion 22 and a rear 54 of the outer portion 20 (either for insertion of the garment into the clamp or removal of the garment from the clamp).

The inner and outer portions 22, 20 may be resiliently flexible or substantially rigid. Preferably the outer portion 20 is substantially rigid, while the inner portion 22 is resiliently flexible.

In the illustrated embodiment, each of the inner and outer portions 22, 20 defines a substantially hourglass shape, and the two portions cooperatively define therebetween an hourglass-shaped space 50. It will be appreciated, however, that other shapes may be used so long as an appreciable space 50 is defined between the lateral sides and bottoms of the inner and outer portions 22, 20, respectively, to facilitate movement of the former through the latter.

In the preferred embodiment illustrated, the inner portion tab 42 projects downwardly from the inner portion body 40, and the outer portion peripheral gap 32 projects downwardly from the outer portion central aperture 30. For particular applications, different orientation of the tab 42 and gap 32 relative to the body 40 and central aperture 30, respectively, may be used.

The hanger 10, as described hereinabove, does not have any overlap of the inner and outer portions 22, 20. Accordingly, the hanger 10 may be injection molded with standard injection molding apparatus devoid of the expensive special features which might be required if there were such an overlap.

Furthermore, since the inner and outer portions 22, 20 occupy a single common plane when telescoped together without a garment therebetween, packaging, shipment and storage of the hangers is more compact, and hence economical, than if the two portions 20, 22 occupied separate parallel planes because they lacked this telescopic feature (regardless of whether or not a garment were disposed between the two portions).

In the preferred embodiment of the invention illustrated, a rib or lug, generally designated 60, projects forwardly of the front 52 of the inner portion body 40 and is configured and dimensioned to pass through the outer portion central aperture 30. The rib 60 is mounted on the inner portion body 40 for movement therewith such that the inner portion body 40 can be moved (relative to the outer portion central aperture 30) from the retaining orientation to the releasing orientation by rearward pressure exerted on the rib 60. Preferably the rib 60 is a horizontal bar projecting forwardly from the front 52 of inner portion body 40.

More particularly, the rib 60 is configured and dimensioned to limit upward movement of the garment intermediate the inner and outer portions 22, 20 even when the hanger 10 is in the releasing orientation. Accordingly, the rib 60 extends substantially across the gap between the inner and outer portions 22, 20 when the hanger is in the releasing orientation. In other words, the rib 60 projects forwardly sufficiently to contact or even enter the outer portion aperture 30.

Figure 8:
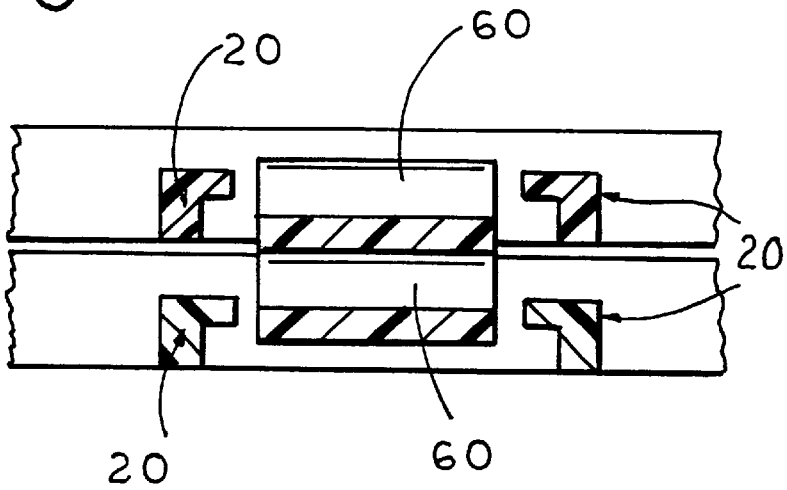
FIG. 8 is a sectional view similar to FIG. 4 but showing a stacked pair of empty hangers.
Figures 5, 6:
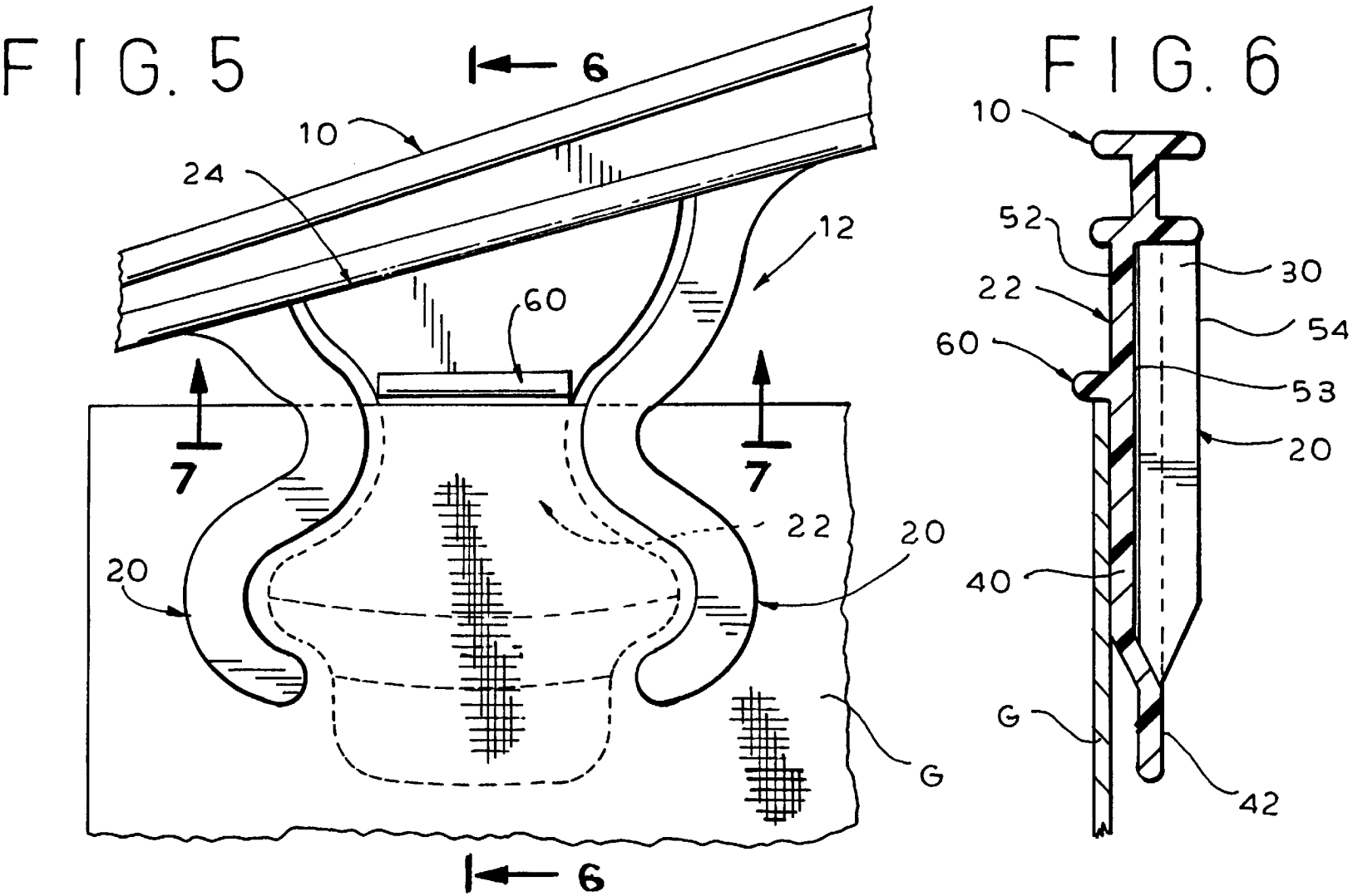
FIG. 5 is a view similar to FIG. 2, but with a garment being suspended.

The rib 60 is of a thickness (i.e., it projects forwardly from the inner portion body 40 towards, into or beyond the outer portion central aperture 30) such that rearward pressure on the rib 60 can displace the rib to an orientation wherein the rib front 62 is not forward of the level of the front of the outer portion 20 and the back of the inner portion 22 is not rearward of the level of the back of the outer portion 20. As illustrated in FIG. 8, this arrangement facilitates compact stacking of an aligned (front-to-back) plurality of the hangers 10 because the pressure exerted by an adjacent hanger will cause the rib 60 and its supporting inner portion body 40 to undergo a telescopic action with the outer portion central aperture 30. Thus, any extension of the rib 60 through and beyond the outer portion central aperture 30 due to the biasing action of the bight portion 24 is overcome by the rearward pressure exerted by an adjacent hanger, and the rib 60 and inner portion body 40 will retreat and telescope into the outer portion aperture 30 (with the inner portion tab 42 retreating into and telescoping with the outer portion gap 32). This hanger configuration facilitates an economical compact stacking of an aligned plurality of the hangers 10 when no garment is present. Alternatively, the rib 60 under stacking conditions may extend forwardly beyond the outer portion 20 provided that it enters into and occupies only an unoccupied volume of the central aperture of an adjacent hanger, as illustrated in FIG. 8. Thus the inner portion 22 and its rib 60 assume an orientation under stacking conditions such that the rib does not extend either forwardly or rearwardly beyond the outer portion 20 or, if it does so extend, it extends into and occupies an unoccupied volume of the central aperture of an adjacent hanger.

An interesting feature of the preferred embodiment of the present invention is that the presence of rib 60 enables the inner portion body 40 to be moveable from the retaining orientation to the releasing orientation by rearward pressure exerted on either the inner portion tab 42 or the rib 60. In this connection, it will be appreciated that the rib 60 limits upward passage of a garment within the clamp, so that the rib extends over the top of the garment and is exposed for contact with a user's finger. Accordingly, the front forward face of rib 60 is preferably configured and dimensioned to receive and be moved by a finger tip pressed on its front face. The ability to open the clamp (that is, to move it to a releasing orientation) by virtue of a rib 60 which is easily accessible by a hanger user, facilitates opening of the clamp 12 either when a garment retained therein blocks easy access of the user to the inner body tab 42 (which is covered by the garment) or when a garment inserted therein is blocked by a user's finger (passing through the outer portion central aperture 30 and depressing the inner portion tab 42). Accordingly, the hanger clamp 12 may be easily moved from the retaining orientation to the releasing orientation by use of the rib 60 without use of the tab 42. Further, the ability to move the clamp 12 into a releasing orientation through use of the rib 60 (rather than the tab 42) facilitates use of automatic machinery and tooling to load the clamp with a garment, thereby rendering the entire process more economical.

Use of the inner portion tab 42 may be relatively difficult for the hanger user. During insertion of the garment into the clamp 12, the user's finger depressing the tab 42 interferes with upward movement of the garment within the clamp. During removal of the garment from the clamp 12, the garment covers (and may even conceal) the tab 42, and the garment is sandwiched between the user's finger exerting rearward pressure on the tab 42 and the tab 42 itself, thereby interfering with release of the garment from the clamp 12.

Alternatively, the hanger may include a rib or lug, generally designated 60', which projects rearwardly from the back 53 of the inner portion body 40 for movement therewith in response to forward pressure exerted on the rib 60'. In all other respects, the rib 60' is identical to the rib 60 as described hereinabove.

Figure 9:
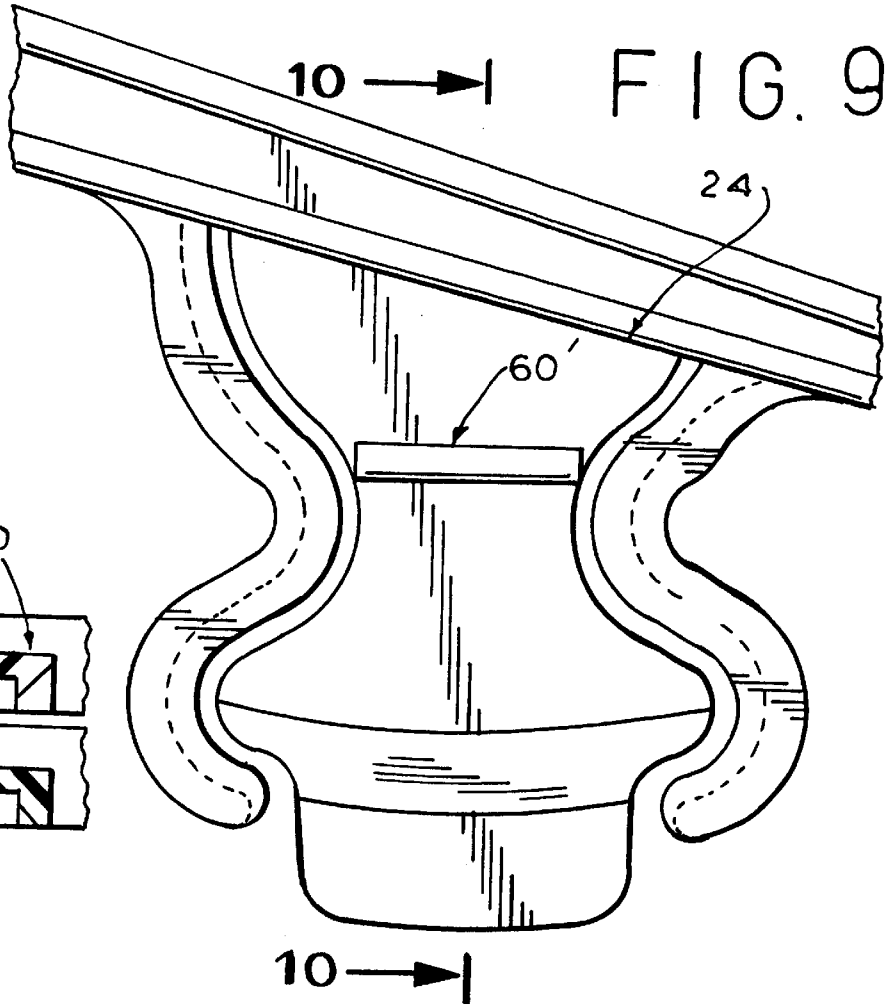
FIG. 9 is an enlarged fragmentary elevational view from the rear of a second embodiment of the hanger having opposing ribs.
Figure 10:
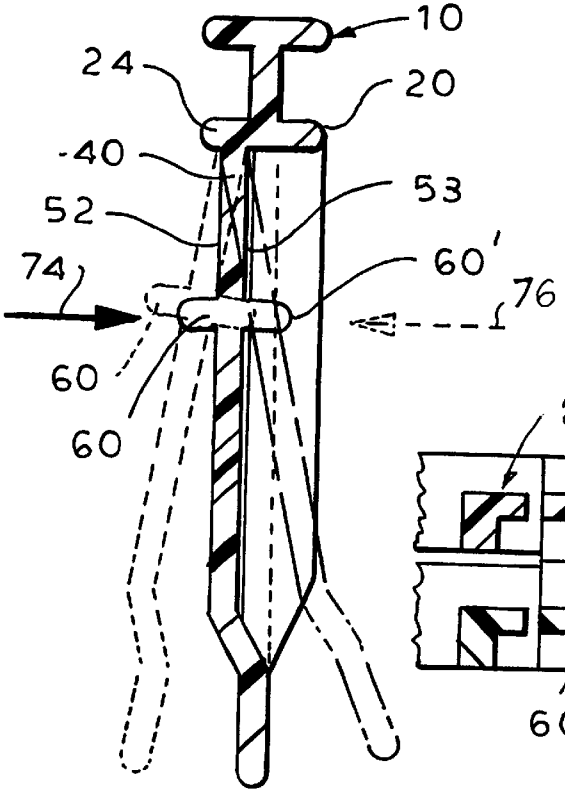
FIG. 10 is a sectional view, taken along the lines 10—10 of FIG. 9.

Indeed, in the preferred embodiment illustrated in FIGS. 9–10, the hanger includes a pair of ribs 60, 60'. Rib 60 projects forwardly from the front of inner portion body 40, and rib 60' projects rearwardly from the rear 53 of 25 inner portion body 40. This construction provides the user with the option of using either the inner portion body tab 42 or one of the ribs 60, 60' to open or close the clamp. Typically, the outer portions 20 are somewhat thicker than the inner portion body 40 in the direction transverse to the plane of the hanger (that is, from the front to the rear of the hanger).

When the hanger is in a manually unstressed orientation, the inner portion body 40 may be disposed towards the rear of the plane or, as illustrated, towards the front of the plane, as desired. Accordingly, the manual movement of the inner portion 22 relative to the outer portion 20 (in order to achieve the same transverse separation between the inner and outer portions 22, 20 and thereby enable the same garment to be inserted into or removed from the clamp) will be easier when the movement is in one direction (here, forward) than when the movement is in the opposite direction (here, rearward). The reason greater force is required to move the inner portion in one direction, as opposed to the other direction, is because the inner portion must be moved further in the one direction in order to allow passage of a garment through the clamp channel than in the other direction. The advantage of this construction, of course, is that it enables the user to use the minimum required force to open a clamp compatible with the provision of a clamp holding strength which is appropriate for the weight of the garment being suspended. As illustrated, the front rib 60 is thicker than the back rib 60', and the bight portion 24 biases the inner portion 22 towards the front 52 of the plane defined by the outer portion 20.

Figure 11:
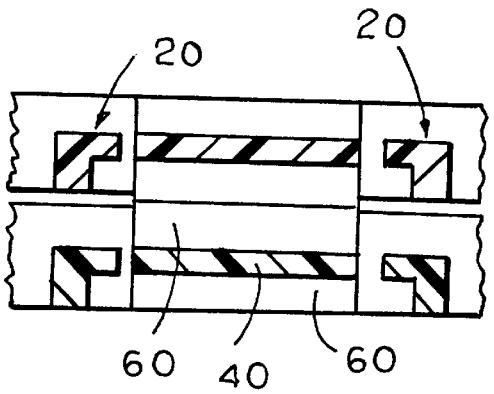
FIG. 11 is a sectional view similar to FIG. 8, but showing a stack of hangers of the second embodiment.

It will be appreciated that the ribs 60, 60' need not extend outwardly (that is, either forwardly or rearwardly, as appropriate) of the inner portion body 40 the same distance. However, as illustrated in FIG. 11, preferably the thickness of the inner portion body 40 (at the level of ribs 60, 60') in combination with the combined thicknesses of the ribs 60, 60' does not exceed the thickness of the outer portion 20 so that compact stacking of the hangers is possible. The inner portion 22 and its ribs 60, 60' assume an orientation under stacking conditions such that neither rib extends either forwardly or rearwardly beyond the outer portion 20 or, if one rib does so extend, it enters into and occupies an unoccupied volume of the central aperture of an adjacent hanger (as illustrated in FIG. 11).

Figure 3:
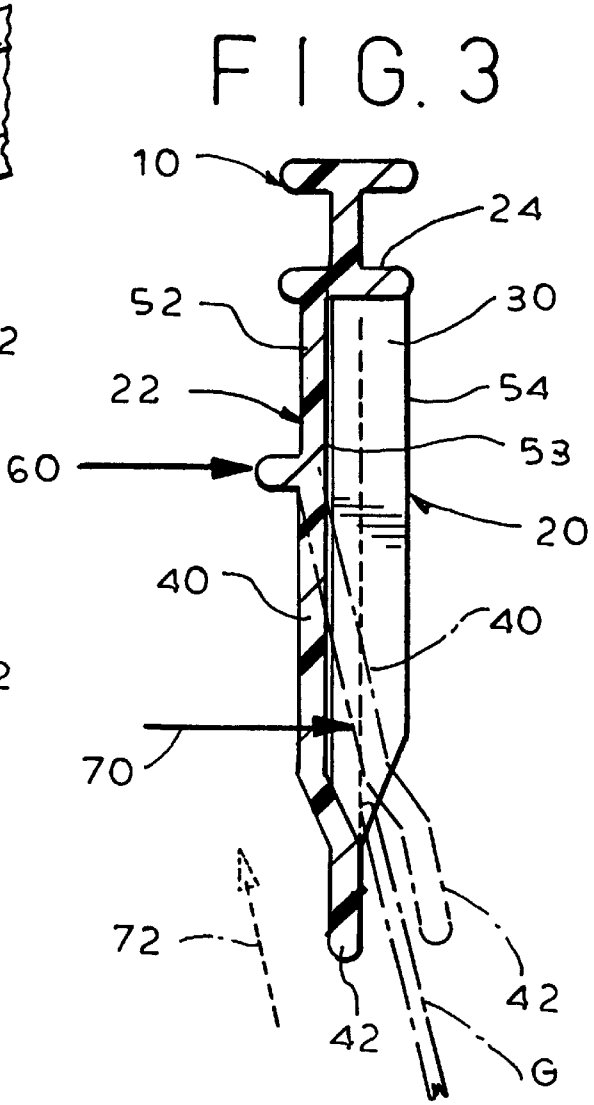
FIG. 3 is a side elevational view thereof, taken along the line 3—3 of FIG. 2, with a tab-displaced inner portion being illustrated in a phantom line.
Figure 2:
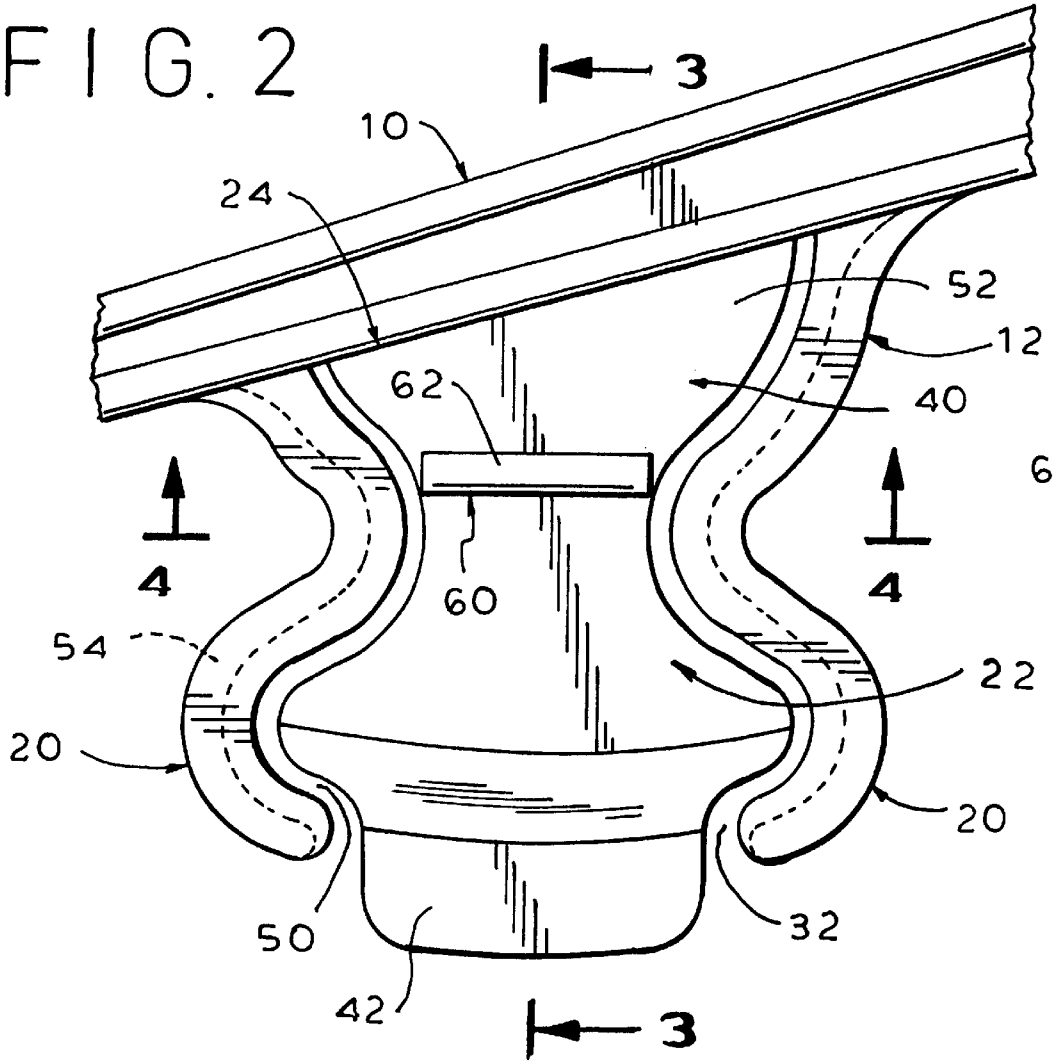
FIG. 2 is an enlarged fragmentary view thereof from the front.
Figure 4:
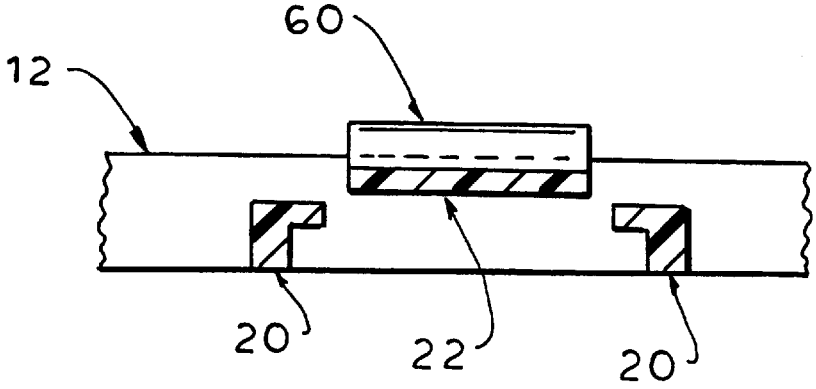
FIG. 4 is a sectional view, taken along the line 4—4 of FIG. 2.
Figure 7:
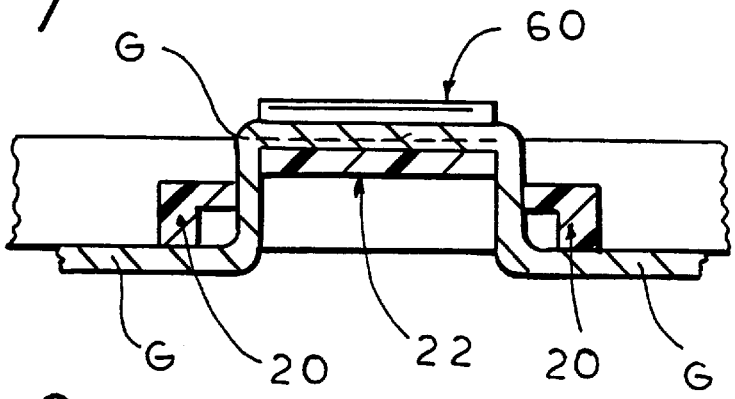
FIGS. 6 and 7 are side and plan sectional views, taken along the lines 6—6 and 7—7, respectively, of FIG. 5.

Preferably, the inner portion 22 is resiliently flexible relative to the outer portion 20, and the outer portion 20 is substantially rigid relative to the inner portion body 40. Precisely where the inner portion body 40 will flex under manual pressure depends on where pressure is exerted thereon. When pressure (see arrow 70) is exerted on the inner portion tab 42, as illustrated in FIG. 3, the tab-displaced inner portion 22 flexes at about the plane of the rib(s) 60, 60' since the ribs 60, 60' rigidifies the inner portion body 40 so that flexing is below the rib level and a garment G (shown in dashed line) may be inserted into the clamp channel (see arrow 72). On the other hand, when pressure (see arrows 74, 76) is exerted on a rib 60, 60', as illustrated in FIG. 10, substantially the entire rib-displaced inner portion 22 (shown in dashed lines as extending up to its connection with the bight portion 24) flexes. It will be apparent to those skilled in the art that the pressure or force required to open a clamp according to the present invention will vary with where the pressure is applied (that is, on the tab or on the rib) due to changes in the moment arm, the pivot points, and the like.

To summarize, the present invention provides a garment hanger having at least one clamp or pinch-grip formed exclusively of plastic for suspending a garment wherein there is no overlapping of the clamp legs so that no expensive special features are required on the injection molding equipment. The legs of the clamp are fully telescopic when aligned hangers are pressed together, and the clamp includes means for limiting automatic or manual insertion of a garment thereinto. The hanger is simple and economical to manufacture and use.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A garment hanger having at least one clamp or pinch-grip formed exclusively of plastic for suspending a garment, said clamp comprising:

(A) an outer portion defining (i) a central aperture therethrough and a partial periphery extending substantially about said central aperture, and (ii) a peripheral gap therethrough in said periphery communicating with said central aperture;

(B) an inner portion defining (i) a body configured and dimensioned to pass through said outer portion central aperture, and (ii) a tab extending outwardly from and communicating with said inner portion periphery, said tab being configured and dimensioned to pass through said outer portion peripheral gap;

(C) a bight portion connecting said inner and outer portions for biasing said inner portion forwardly relative to said outer portion towards a retaining orientation for retaining a garment disposed at least partially intermediate a front of said inner portion and a rear of said outer portion;

said inner portion being rearwardly displaceable by rearward pressure on said inner portion tab to a releasing orientation enabling a garment to pass intermediate a front of said inner portion and a rear of said outer portion; and (D) at least one rib projecting from said inner portion body and configured and dimensioned to pass through said outer portion central aperture for blocking upward movement of a garment intermediate said inner and outer portions even when said hanger is in said releasing orientation, said rib being mounted on said inner portion body for movement therewith such that said inner portion body can be moved from said retaining orientation to said releasing orientation by pressure on said rib.

2. The hanger of claim 1 wherein said rib is of a thickness such that, under stacking conditions, pressure on said rib can displace said rib to an orientation wherein the front of said rib is not substantially forward of the level of the front of said outer portion, and the back of said rib is not substantially rearward of the level of the back of said outer portion, thereby to facilitate compact stacking of an aligned plurality of said hangers, and any portion of a rib extending outwardly from the plane of said outer portion central aperture is received in an unoccupied volume of an outer portion central aperture of an adjacent hanger.

3. The hanger of claim 1 wherein said inner portion body can be moved from said retaining orientation to said releasing orientation by rearward pressure on either of said inner portion tab and said rib.

4. The hanger of claim 1 wherein said rib projects forwardly from a front of said inner portion body.

5. The hanger of claim 1 wherein said rib projects rearwardly from a rear of said inner portion body.

6. The hanger of claim 1 including a pair of ribs, one projecting forwardly from a front of said inner portion body and one projecting rearwardly from a rear of said inner portion body.

7. The hanger of claim 6 wherein said pair of ribs are of a thickness such that, under stacking conditions, any portion of a rib extending outwardly from the plane of said outer portion central aperture is received in an unoccupied volume of an outer portion central aperture of an adjacent hanger.

8. A garment hanger having at least one clamp or pinch-grip formed exclusively of plastic for suspending a garment, said clamp comprising:

(A) an outer portion defining (i) a central aperture therethrough and a partial periphery extending substantially about said central aperture, and (ii) a peripheral gap therethrough in said periphery communicating with said central aperture, said outer portion defines only a single central aperture and only a single peripheral gap;

(B) an inner portion defining (i) a body configured and dimensioned to pass through said outer portion central aperture, and (ii) a tab of substantial width extending outwardly from and communicating with said inner portion periphery, said tab being configured and dimensioned to pass through said outer portion peripheral gap;

(C) a bight portion connecting said inner and outer portions at the tops thereof for biasing said inner portion forwardly relative to said outer portion towards a retaining orientation for retaining a garment disposed at least partially intermediate a front of said inner portion and a rear of said outer portion;

said inner and outer portions in said retaining orientation cooperatively defining therebetween a space and being substantially in a common plane when no garment is disposed therebetween;

said inner portion tab projecting downwardly from said inner portion body, and said outer portion peripheral gap projecting downwardly from said outer portion central aperture; and said inner portion being rearwardly displaceable by rearward pressure on said inner portion tab to a releasing orientation enabling a garment to pass intermediate a front of said inner portion and a rear of said outer portion; and (D) a rib projecting forwardly of a front of said inner portion body and configured and dimensioned to pass through said outer portion central aperture, said rib being mounted on said inner portion body for movement therewith such that said inner portion body can be moved from said retaining orientation to said releasing orientation by rearward pressure on said rib;

said rib being configured and dimensioned to block upward movement of a garment intermediate said inner and outer portions, even when said hanger is in said releasing orientation;

said rib being of a thickness such that, under stacking conditions, rearward pressure on said rib can displace said rib to an orientation wherein the front of said rib is not substantially forward of the level of the front of said outer portion, and the back of said rib is not substantially rearward of the level of the back of said outer portion, thereby to facilitate compact stacking of an aligned plurality of said hangers; and any portion of a rib extending outwardly from the plane of said outer portion central aperture is received in an unoccupied volume of an outer portion central aperture of an adjacent hanger;

said inner portion body being movable from said retaining orientation to said releasing orientation by rearward pressure on either of said inner portion tab and said rib.

9. The hanger of claim 8 including a pair of ribs, one projecting forwardly from a front of said inner portion body and one projecting rearwardly from a rear of said inner portion body.

10. The hanger of claim 9 wherein said pair of ribs are of a thickness such that, under stacking conditions, any portion of a rib extending outwardly from the plane of said outer portion central aperture is received in an unoccupied volume of an outer portion central aperture of an adjacent hanger.

11. The hanger of claim 1 wherein said inner portion is no thicker than said outer portion.

12. The hanger of claim 1 wherein said inner portion has a thickness through said tab not exceeding the thickness of said outer portion through said peripheral gap.

13. The hanger of claim 1 wherein said inner portion substantially defines a plane thinner than the plane substantially defined by said outer portion.

14. The hanger of claim 1 wherein said tab defines a plane substantially thinner than the plane defined by said peripheral gap.

15. The hanger of claim 8 wherein said inner portion is no thicker than said outer portion.

16. The hanger of claim 8 wherein said inner portion has a thickness through said tab not exceeding the thickness of said outer portion through said peripheral gap.

17. The hanger of claim 8 wherein said inner portion substantially defines a plane thinner than the plane substantially defined by said outer portion.

18. The hanger of claim 8 wherein said tab defines a plane substantially thinner than the plane defined by said peripheral gap.

19. The hanger of claim 1 wherein said inner portion body is no thicker than said outer portion body.

* * * * *